US005479712A

United States Patent [19]

Hargrove et al.

[11] Patent Number: 5,479,712

[45] Date of Patent: Jan. 2, 1996

[54] TRIANGULATION RANGEFINDER FOR ARCHERS

[76] Inventors: Jeffrey B. Hargrove, 3001 E. Miller Rd., Bancroft, Mich. 48414; William G. Wickham, 4880 W. Britton Rd., Perry, Mich. 48872; John E. Briggs, 202 Howard St., Morrice, Mich. 48857

[21] Appl. No.: 261,936

[22] Filed: Jun. 17, 1994

[51] Int. Cl.[6] ..... F41B 5/14

[52] U.S. Cl. ..... 33/265; 33/228; 33/262; 33/701; 124/88

[58] Field of Search ..... 33/228, 262, 263, 33/265, 281, 282, 283, 284, 701, 391, 700, 709; 124/86, 87, 88; 356/3, 4, 11, 15, 18; 364/561

[56] References Cited

U.S. PATENT DOCUMENTS

| | | | |
|---|---|---|---|
| 3,696,517 | 10/1972 | Larson | 33/265 |
| 4,120,096 | 10/1978 | Keller | 33/265 |
| 4,551,847 | 11/1985 | Caldwell | 33/755 |
| 4,580,349 | 4/1986 | Webb et al. | 33/265 |
| 4,785,541 | 11/1988 | Lowry | 33/265 |
| 4,787,739 | 11/1988 | Gregory | 356/4 |
| 4,796,364 | 1/1989 | Amacker | 33/265 |
| 4,894,291 | 1/1990 | Barlow | 33/265 |
| 4,974,328 | 12/1990 | Lowry | 33/265 |
| 4,984,372 | 1/1991 | Blizzard | 33/265 |
| 5,229,828 | 7/1993 | Wiklund | 356/4 |

*Primary Examiner*—William A. Cuchlinski, Jr.
*Assistant Examiner*—G. Bradley Bennett

[57] ABSTRACT

An archery rangefinder for use from an elevated position comprises a power supply for an electronic digital panel meter and a power supply for two voltage divider circuits that comprise the rangefinding circuit. One voltage divider provides a voltage signal proportional to the elevation distance. This signal acts to supply the second voltage divider to attenuate the voltage further by a factor proportional to the tangent of the inclination angle. A weighted pendulum arm is attached to a potentiometric element in the second voltage divider to effect feedback relevant to the angle of inclination. All circuits and components are housed within an outer protective enclosure. Voltage across a fixed resistor in the second voltage divider is read and displayed by said digital panel meter as the range which is then used by the archer to increase accuracy of shots.

5 Claims, 2 Drawing Sheets

TRIANGULATION RANGEFINDER FOR ARCHERS

BACKGROUND OF THE INVENTION

1. Field of the Invention

The present invention relates in general to the sport of archery, and in particular to determining the distance from the archer to the intended target for improved shot accuracy.

2. Description of Related Art

The capability of an archer to accurately judge the distance to his or her intended target is critical to shot accuracy. Unlike projectiles from guns, an arrow's trajectory is very non-linear over relatively short distances. In the case of hunting with a bow, incorrect compensation for target distance and the resulting arrow "drop" can lead to a missed shot or worse yet, a wounded animal.

In order to provide background information so that the invention may be completely understood and appreciated in its proper context, reference may be made to a number of prior art patents and publications as follows:

U.S. Pat. No. 4,617,741 to Bordeaux et al discloses an electronic rangefinding apparatus for attachment to a bow that allows the user to bracket a target of known size inside a transparent viewing window. This bracketing action is accomplished by electronically moving an upper bracketing line within the viewing window by actuation of a control switch. Once the object is bracketed, the device electronically estimates and displays range by relating bracket size to target distance. This general method of range estimation has been employed in a number of other patents, including U.S. Pat. No. 4,984,372 to Blizzard, U.S. Pat. No. 4,787,739 to Gregory, and U.S. Pat. No. 3,696,517 to Larson. This method is sensitive to the type and size of the target, and erroneously assumes that all targets of the same type are of the same size. Furthermore, a specific action is imparted upon the device by the archer during the ranging operation. This differs from the current invention, in which target range is estimated by sensing the angle made by an archer at a calibrated elevation as he draws the bow down and aims at the target. Range is then determined trigonometrically from said angle and elevation.

However, the concept of triangulation for rangefinding in archery has been addressed in U.S. Pat. No. 4,785,541 by Lowry wherein a device is described in which fluid level in a translucent tube is observed against a graduated scale calibrated for various heights above the ground. The device rotates when drawn down, changing the liquid level against the scale and hence indicating the range. Although this method is based on triangulation, several critical aspects are not addressed that are integral to the present invention. First, the present invention utilizes a liquid crystal digital display to numerically present the range without reading a scale. Secondly the present invention, as will be explained later in detail, electronically compensates for infinitesimal differences in height to provide improved accuracy through precise triangulation. Furthermore, the present invention determines range based on whatever measurement scale the archer is using, thus not limiting him to yards as is typically used in most rangefinding devices. This aspect is perhaps the most critical, since a significant number of archers calibrate their bow's sighting system to ranges measured by individual "paces", with actual measurements unique to the walking stride of each archer.

Triangulation is also the basis for U.S. Pat. No. 4,894,921 by Barlow wherein a device is described in which a weighted pendulum arm is attached to a rotary switch shaft to rotate the switch as the bow inclination changes. Depending upon a particular switch closure, one of several light emitting diodes or lamps will illuminate, thus indicating which sight pin should be appropriately used. The primary disadvantage of this device is that only a discreet number of switches is utilized, and thus ranges reported can only be considered approximate, with typical resolution of only plus/minus five yards. Furthermore, the device proposes to compensate for various elevations by manually changing the pendulum's position relative to the switch shaft. This method of compensating for elevation would only be accurate if the trigonometric function relating elevation to distance was linear, which it is indeed not. In the present invention, an analog signal is provided that is proportional to the non-linear trigonometric transfer function. Hence continuous resolution is attained, and by varying with infinite resolution the magnitude of the supply voltage proportional to the elevation, a true range based on the mathematic principles of triangulation is achieved.

Furthermore, several "rangefinding sights" for archery have been proposed that pivot a sighting pin relative to the angle of inclination from an elevated position or provide for manual sight pin adjustment after range has been estimated by the archer. For example see U.S. Pat. No. 4,580,349 by Webb et al. These merely lead the archer to compensate for the additional projectile drop in a longer shot by causing the bow to be aimed higher. They do not in any way determine and report the actual range.

Whatever the precise merits, features and advantages of the above cited references, none of them achieves or fulfills the purposes of the current rangefinding capabilities of the present invention.

SUMMARY OF THE INVENTION

The principal object of the present invention is to provide a device to achieve greater accuracy in the measurement of the distance from a target to an archer in an elevated position.

It is another principal object of the present invention to provide a means of calibrating the device to provide range measurement units that are consistent with those used by the individual archer.

Another object is to provide a device which, while in use, will need no operator input or adjustment.

A further object is to provide an electro-mechanical mechanism that provides a trigonometric function, specifically the tangent of the angle made by a line defined by endpoints at the bow and the target and a vertical line downward from the bow, to be used in the triangulation process of range determination.

A further object is to provide a device that can be calibrated from the elevated position on an object of known distance, eliminating the need to know the height above the object, and thus increase user confidence in the accuracy of the reported range.

The foregoing objects can be accomplished by providing a device that mounts directly to the bow and determines target range by measuring a combined electrical voltage level that is proportional to i) the height of the device above the ground, and ii) the tangent of the angle described above. In the preferred embodiment of the invention, all mechanical and electronic components are mounted in an enclosure and attached to the bow by two mounting screws through standard sight bracket holes. Power is provided by a single nine-volt battery within the enclosure. Calibration is accomplished by changing an electrical voltage level that is proportional to the height above the ground by adjusting a trimmer potentiometer, accessible from outside the enclosure, which is part of a voltage divider circuit being fed by a voltage regulator. The angle tangent function is accomplished by a weighted pendulum attached to a potentiometer that is part of another voltage divider circuit. As will be seen in the detailed description section, careful choice of values for this circuit must be made to emulate the tangent function. The height calibrated voltage is attenuated by the tangent function and measured by a 3½ digit panel meter that is mounted to the enclosure and is visible to the archer. This measured voltage is numerically equivalent to the distance from the target to a point on the ground directly below the point of elevation.

DETAILED DESCRIPTION

Figure 1:
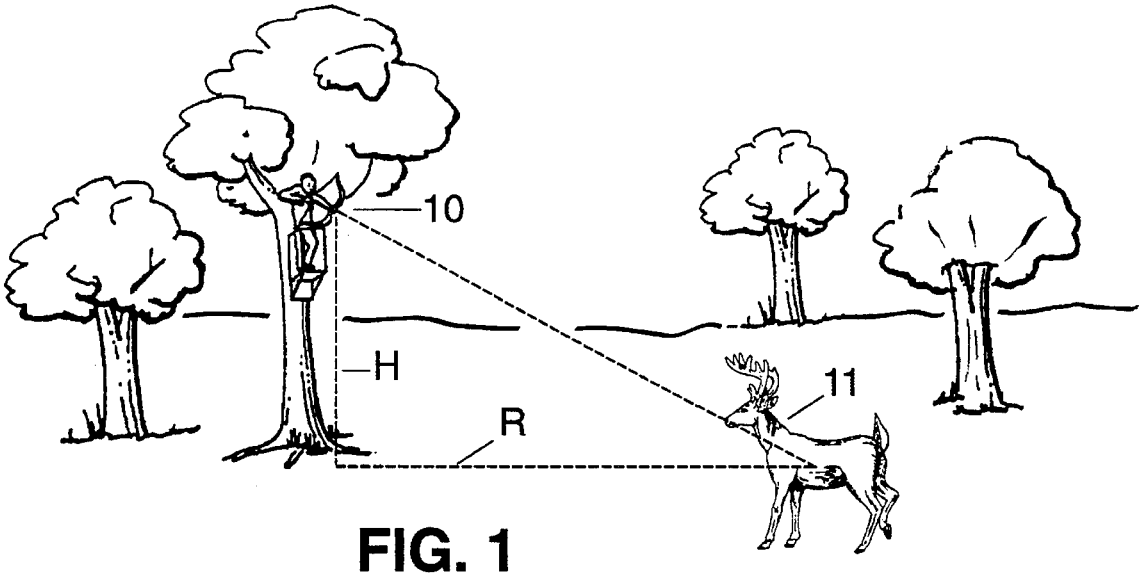
FIG. 1 is a perspective view of an archery hunter, tree stand, and a deer representing a potential target.

In elementary trigonometry, the sides and angles of a right triangle are related by ratios of the lengths of adjacent legs. A particular one of these ratios is known as the tangent, and for a given angle, it is the ratio of the length of the triangle leg that is opposite said angle divided by the adjacent leg that is not the triangle's hypotenuse. The present invention uses this form of mathematics to determine range. This is best illustrated by considering, with reference to FIG. 1, the right triangle made between the archer 10 at an elevated position, the target 11, and a point on the ground directly below the archer, henceforth referred to as the base point. If the archer draws and aims his bow at the target, an angle is made between the vertical line H from the archer 10 to the base point and the line connecting the archer 10 and the target 11. This angle is henceforth referred to as the inclination angle. From trigonometry theory, the tangent of the inclination angle is given by the ratio of the length of line R, which represents the distance between the base point and the target 11, to the length of line H, henceforth referred to as elevation. The length of line R is the desired range. By rearranging the ratio equation, the range is given by the elevation multiplied by the tangent of the inclination angle. This relationship provides for an improved method for determining target range by an archer in an elevated position, and is the fundamental basis for the present invention. Reference will be made to this relationship as the circuits that realize it are described.

Figure 2:
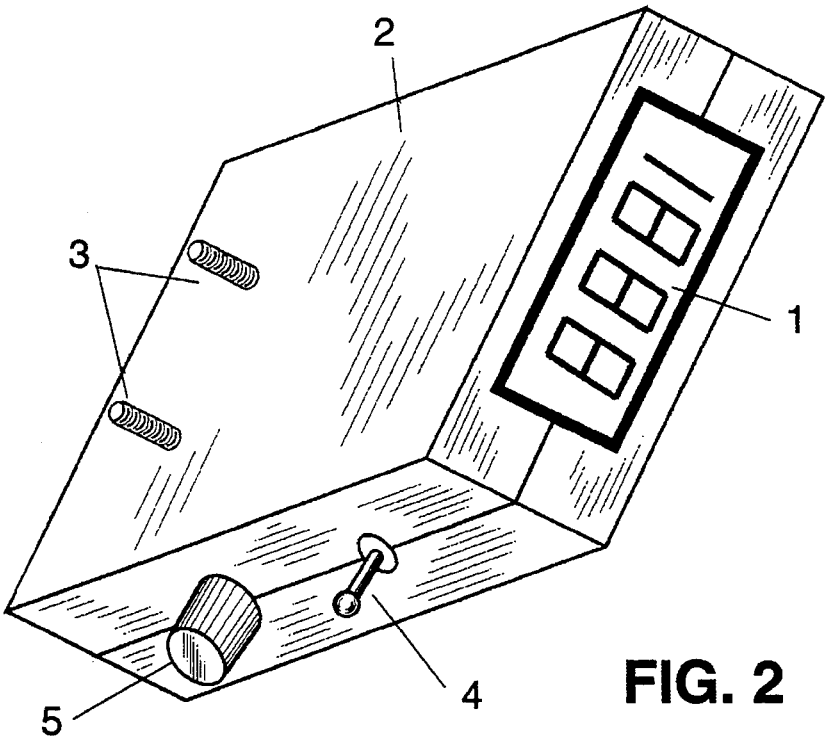
FIG. 2 is a perspective of the outer enclosure and display of the rangefinder in accordance with the present invention.

With reference to FIG. 2, the preferred embodiment of the device in accordance with the present invention includes a liquid crystal diode 3½ digit panel meter 1, with backlighting for viewing in low light conditions, mounted flush with a surface of an outer protective enclosure 2 with means to mount to hand held objects, and is mounted so that it will be facing the operator when in use.

The device attaches to a hand held object, such as a compound bow, by securing two screws 3 entrapped between the battery housing of the enclosure 2 and the outer wall of the enclosure 2 to the standard sight bracket holes found on all compound bows. This method of attachment assures that the invention will be parallel to a horizontal plane when the bow is aimed parallel to the ground. The battery housing, sized to accommodate a standard 9 volt battery 7, is integrally molded into the enclosure 2.

On the side of the enclosure 2 that faces downward with respect to the device in the mounted position is a single-pole single-throw switch 4 which acts as a means to turn the rangefinder on and off, and an adjustment knob 5 that is connected to a trimmer potentiometer 6. This is used to calibrate the device, while the archer 10 is in the elevated position, on an object of known distance. Both the switch 4 and the adjustment knob 5 are mounted on the downward side of the device to minimize the chance of interference or accidental contact by the archer 10 during use.

Figure 4:
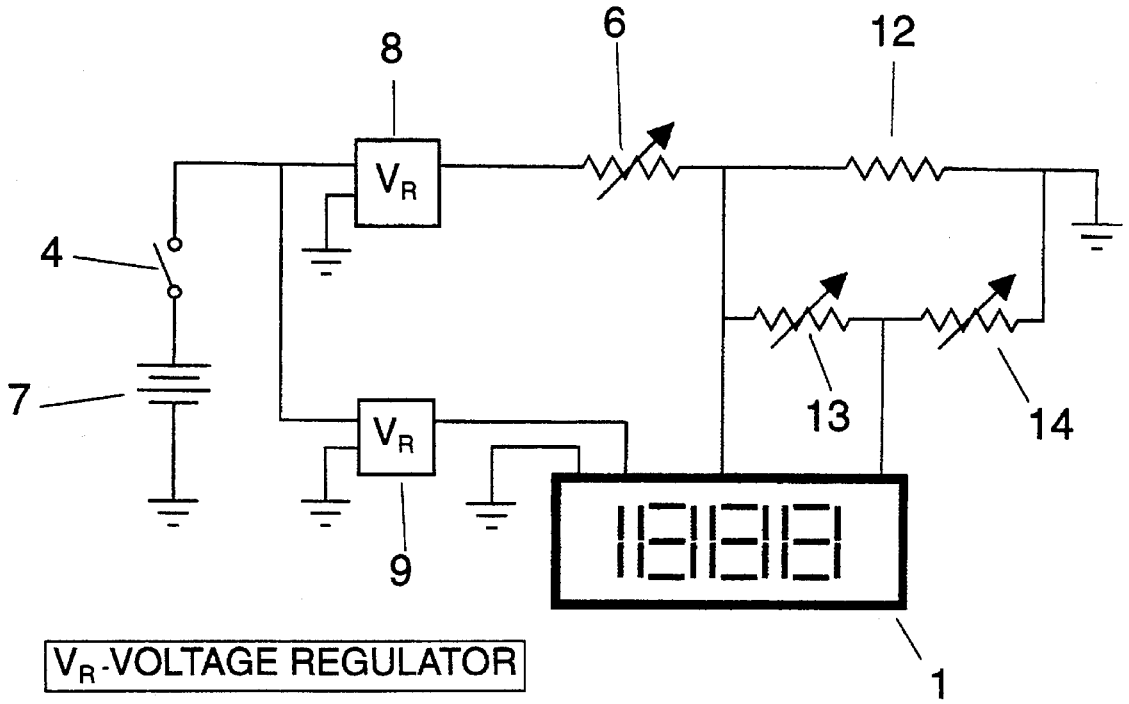
FIG. 4 is a schematic of the device's circuit.

With reference to FIG. 4, the circuit used to determine range is derived from two separate resistive voltage divider circuits. A means of powering all circuits of the device by a battery is achieved with a single 9 volt battery 7. To provide the voltage divider circuits with a steady voltage, hence minimizing error resulting from a weak battery 7, a 400 millivolt voltage regulator 8 is used. Another voltage regulator, in this case a 5-volt regulator 9, is used to power the digital panel meter 1 and its internal backlighting circuit. Power from the battery 7 to both of these elements is controlled by the switch 4, and both elements are tied to a common ground. Hence, battery 7 powered regulation to supply both the rangefinding circuit and the means of digitally displaying the range is accomplished.

The theory of a voltage divider circuit, in accordance with Kirchoff's voltage law, states that for any two resistors (for example $R_1$ and $R_2$) connected in series and supplied by a voltage $V_s$, the voltage across $R_1$ ($V(R_1)$) will be given by the product of $V_s$ and the ratio of $R_1$ to the sum of $R_1$ and $R_2$. This can be restated in equation format:

$$V(R_1) = V_s \frac{R_1}{R_1 + R_2}$$

Likewise, the voltage across $R_2$ ($V(R_2)$) is given as:

$$V(R_2) = V_s \frac{R_2}{R_1 + R_2}$$

Utilizing this concept, a rangefinder for determining distances from a point directly below a position of elevation (i.e. base point) to an object of interest can be realized. In the preferred embodiment of the invention, the first voltage divider circuit is comprised of the 400 millivolt regulator 8 which acts as a supply voltage, a 47 ohm fixed resistor 12, and a 0–1000 ohm trimmer potentiometer 6 which acts as a means of varying one resistance. Hence, the voltage across the fixed resistor 12 has a range of approximately 18 to 400 millivolts, depending upon the value of the trimmer potentiometer 6. This variable voltage, henceforth referred to as the elevation voltage, is a means of providing a voltage that is proportional to elevation. In this case, the voltage in millivolts is equivalent to the elevation units multiplied by a factor of ten. This voltage across the fixed resistor 12 now acts to supply input to the second voltage divider. The purpose of the second voltage divider is to provide an analog sensor to further attenuate this input voltage signal from the first voltage divider by a factor that is proportional to the tangent of the inclination angle.

Figure 3:
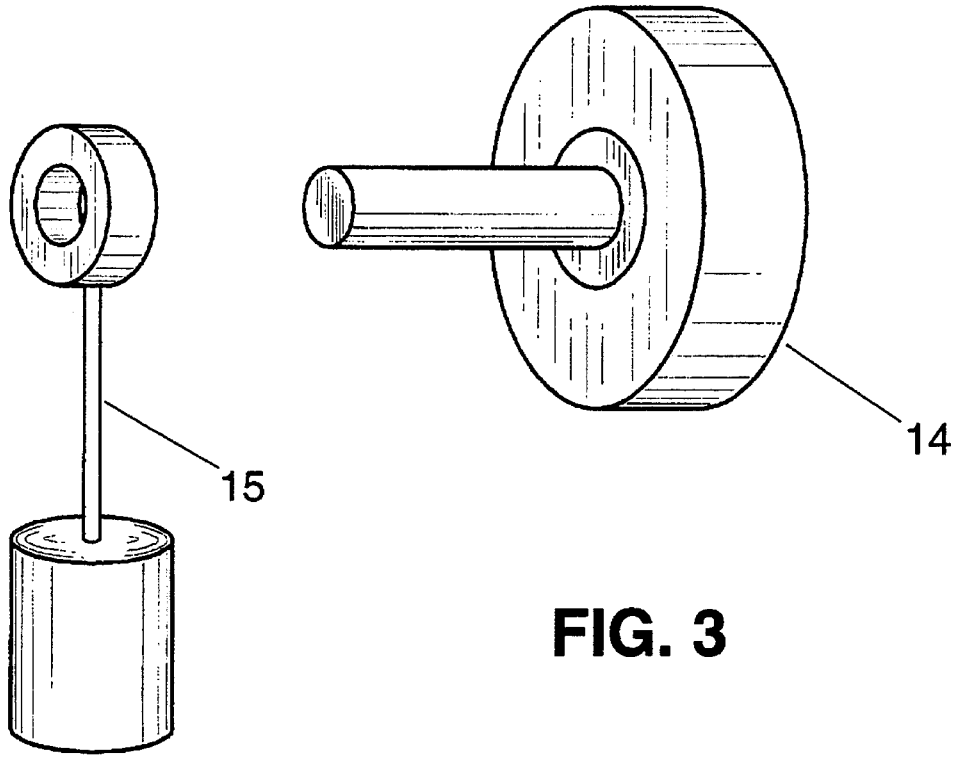
FIG. 3 is an exploded view of the pendulum and potentiometer mechanism.

A second voltage divider circuit is provided with one potentiometric device and one fixed resistance for providing an attenuating ratio for the elevation voltage described above proportional to the tangent of the inclination angle. In the preferred embodiment of the invention, the second voltage divider consists of a 24,585 ohm fixed resistance that is achieved by adjusting and cementing a second trimmer potentiometer 13, and a 0–1,000,000 ohm potentiometer 14. Henceforth, the resistance provided by the cemented trimmer potentiometer 13 will be referred to as the fixed resistance of the second voltage divider. A means of rotating said potentiometric device radially proportional to the inclination angle is provided. With reference to FIG. 3, a weighted pendulum is affixed to the shaft of the potentiometer 14 to rotate said potentiometer 14 with respect to the inclination angle and alter the voltage divider resistance. The range of motion of the pendulum 15 during the invention's operation includes inclination angles between 83 and 45 degrees. This range of angles represents the most likely range of shots that can be made. Inclination angles less than 45 degrees represent shots that are close enough in distance to not require range information to make an accurate shot. The potentiometer 14 is affixed to the printed circuit board 16 so that at an inclination angle of 83 degrees its resistance is 1000 ohms. Accordingly, as the inclination angle decreases to a minimum of 45 degrees, the resistance of this potentiometer increases to approximately 180,000 ohms. The combination of the fixed resistance of the second voltage divider 13 and the potentiometer 14 gives a voltage attenuation ratio in the second voltage divider circuit that very closely approximates the tangent, divided by a factor of ten, of the inclination angle. Hence, the voltage across the fixed resistance of the second voltage divider 13 is effectively the second voltage divider supply voltage as defined above multiplied by the voltage attenuation ratio. Hence, a means of combining an input voltage signal proportional to elevation and the tangent of the inclination angle to emulate the trigonometric principle of triangulation for range determination is provided. The result is a millivolt signal that represents elevation multiplied by the tangent of the inclination angle, which is the range to the target 11 as defined by line R.

This millivolt signal is measured across the fixed resistance of the second voltage divider 13 and numerically displayed as the desired range by the 3½ digit digital panel meter 1 which is configured to read voltage levels from 0–200 millivolts and is powered independently by the 5-volt regulator 9.

Once attached to the bow as described above, the device is operated by first measuring the distance from the base point to a fixed object in proximity to an expected shot of average distance. This measurement can be made with whatever units the individual archer prefers to utilize. Upon ascending to an elevated point the archer enables the device by turning on the switch 4, draws down on the fixed object of known distance using a constant reference sight point (such as a sight pin) of his choice, and compares the displayed number to the known distance. The adjustment knob 5 can be turned until the displayed number matches the known distance. Thus, a rangefinding apparatus comprising of a means of setting elevation voltage without knowing said elevation distance and a means of calibration to the units of measure preferred by the user is accomplished. At this point the device is calibrated for that particular elevation and is ready for operation. Hence, during future operation at this elevation, the device is simply drawn down on any target, sighting to the same fixed reference point as noted above. The number displayed is the range to the target in the units of measure used by the archer.

An alternate embodiment of the invention might utilize a liquid filled potentiometric element to replace the potentiometer 14 and the pendulum 15, hence reducing weight and size. Another version could utilize a pendulum 15 mounted on the outside of the electronics enclosure 2 to again minimize size. Another possible method of accomplishing range measurement uses the same pendulum 15 and potentiometer 14 arrangement to control the rate of pulse generation in a timing circuit. These pulses could be counted and displayed using a seven-segment liquid crystal diode with counter circuit, thus eliminating the need for a panel meter 1. A further embodiment of the invention might be capable of being mounted differently to a bow or to an apparatus providing a means for hand held operation, hence eliminating the need to mount to a bow. Furthermore, alternate resistance values than those described in the voltage divider circuits may be used to provide a variable elevation voltage and tangent function attenuation. However, since the second voltage divider acts as a parallel resistance to the fixed resistance 12 in the first voltage divider, it is critical that typically low resistance values be used in the first voltage divider and high resistance values be used in the second voltage divider to minimize equivalent parallel resistance error in the first divider circuit. A means of providing electrical connections and transmission paths for all circuits and components described herein is provided. In the preferred embodiment of the invention, a printed circuit board 16 is used to minimize circuit size and thus space requirements.

The device described will provide improved range estimation for archers at elevated points by combining the mechanical motion of a weighted pendulum 15 with electronic circuits that emulate mathematical functions to trigonometrically determine range. By calibrating the device to a fixed object of distance measured with the individual archer's preferred units of measure, the device will provide range in accordance with said preferred unit of measure, thus fulfilling the principal objects of the invention as well as the further stated object of providing a device that utilizes the trigonometric tangent function for range estimation. Furthermore, because calibration is done prior to regular use of the device without knowledge of the elevation needed, the user will impart no further action upon the device while in operation, thus fulfilling other stated objects.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A bow mountable rangefinding apparatus for use from an elevated position, said apparatus comprising:

an analog sensor to attenuate a voltage signal in proportion to the tangent of the angle made by tilting the bow about a horizontal axis, said angle being formed between a vertical axis and the line of sight made between the bow and a target when said bow is tilted about said horizontal axis;

a means for pivotably mounting said sensor on said horizontal axis;

a means for adjusting said voltage signal to a level proportional to elevation; a means for supplying said voltage signal to said sensor; a means for attenuating the said voltage signal by the tangent of said angle to emulate the principle of triangulation for range determination;

a means to measure and numerically display the attenuated voltage signal as a number representing target range;

a means for attaching said measurement and display device to the output voltage signal of said sensor;

a means of powering all circuits of the device by a battery;

a switching means for selectively energizing said circuits;

a means wherein said sensor, voltage signal adjustment circuitry, measurement and display device, battery and switch are secured in a housing; and a means for securing said housing to the bow.

2. A sensor of claim 1 where the attenuation proportional to the tangent of the angle defined is provided by a potentiometer and fixed resistance connected to form a resistive voltage divider circuit.

3. A sensor for determining target range according to claim 1, wherein a weighted pendulum mechanism is affixed to a potentiometer to rotate said potentiometer with respect to the angle defined and alter the voltage divider resistance.

4. A bow mounted rangefinding method from an elevated position comprising:

measuring target range utilizing a voltage proportional to the elevation;

attenuating said voltage proportional to the tangent of an angle defined by tilting the bow about a horizontal axis, said angle being formed between a vertical axis and the line of sight made between the bow and a target when the bow is tilted about said horizontal axis;

accurately setting said voltage without knowing said elevation;

displaying the attenuated voltage to be read by the user as a number representing target range; and calibrating the display to units of measure uniquely defined by the user.

5. A rangefinder for determining distances from a point directly below a point of elevation to a target comprising:

an outer protective enclosure with means provided to mount to hand held objects such as a bow;

means to switch said rangefinder on and off;

a means of affixing two voltage regulators to a single battery power supply;

a first voltage divider circuit with means of varying one resistance to provide a voltage proportional to elevation;

a means of attaching said first voltage divider circuit to said voltage regulator;

a second voltage divider circuit with one potentiometric device and one fixed resistance for providing an attenuating ratio for the voltage proportional to the elevation described above, said attenuating ratio is proportional to the tangent of the angle defined by tilting the said rangefinder about a horizontal axis, said angle being formed between a vertical axis and the line of sight made between the rangefinder and a target;

a means of connecting said second voltage divider to said first voltage divider so that the voltage across the variable resistance of the first voltage divider becomes the input voltage to the second voltage divider:

a means of rotating said potentiometric device radially equivalent to the angle defined above;

a digital panel meter with back lighting integrally mounted to the enclosure to measure voltage across the said fixed resistance in the second voltage divider circuit and numerically display this voltage as the desired range;

a means of powering said digital panel meter by connecting to said voltage regulator;

a means of connecting said digital panel meter to the fixed resistance of said second voltage divider to measure and display the voltage across said resistor:

a means for mounting all components and circuits within said outer protective enclosure: and a means for providing electrical connections and transmission paths for all circuits and components described herein.

* * * * *